US012305393B1

(12) United States Patent
Fiala, Jr.

(10) Patent No.: US 12,305,393 B1
(45) Date of Patent: May 20, 2025

(54) HEMP-BASED STRUCTURAL COMPOSITES AND METHODS OF MAKING HEMP-BASED STRUCTURAL COMPOSITES

(71) Applicant: Theodore James Fiala, Jr., Schenectady, NY (US)

(72) Inventor: Theodore James Fiala, Jr., Schenectady, NY (US)

( * ) Notice: Subject to any disclaimer, the term of this patent is extended or adjusted under 35 U.S.C. 154(b) by 530 days.

(21) Appl. No.: 17/655,904

(22) Filed: Mar. 22, 2022

Related U.S. Application Data

(60) Provisional application No. 63/164,623, filed on Mar. 23, 2021.

(51) Int. Cl.
*E04C 3/28* (2006.01)
*E04C 2/16* (2006.01)

(52) U.S. Cl.
CPC . *E04C 3/28* (2013.01); *E04C 2/16* (2013.01)

(58) Field of Classification Search
None
See application file for complete search history.

(56) References Cited

U.S. PATENT DOCUMENTS

| | | | |
|---|---|---|---|
| 2,717,420 | A | 9/1955 | Roy |
| 4,091,153 | A | 5/1978 | Holman |
| 5,516,472 | A | 5/1996 | Laver |
| 5,935,368 | A | 8/1999 | Tingley |
| 6,153,293 | A | 11/2000 | Dahl et al. |
| 6,579,605 | B2 | 6/2003 | Zehner |
| 6,746,747 | B2 | 6/2004 | Davies et al. |
| 6,793,855 | B2 | 9/2004 | Cheolas et al. |
| 6,841,231 | B1 | 1/2005 | Liang et al. |
| 6,841,239 | B2 | 1/2005 | Hasegawa |
| 6,872,273 | B2 | 3/2005 | Davies et al. |
| 6,972,144 | B2 | 12/2005 | Roth et al. |
| 6,984,676 | B1 | 1/2006 | Brandt |
| 7,326,740 | B2 | 2/2008 | Stadler et al. |
| 8,556,306 | B1 | 10/2013 | Lin |
| 8,894,789 | B2 | 11/2014 | Chang |
| 8,985,034 | B2 | 3/2015 | Dummett |

(Continued)

FOREIGN PATENT DOCUMENTS

| | | | |
|---|---|---|---|
| CA | 2261921 | A1 | 8/1999 |
| CA | 2977774 | A1 | 3/2018 |

(Continued)

*Primary Examiner* — Jeffrey D Washville
(74) *Attorney, Agent, or Firm* — Tech Valley Patent, LLC; John Pietrangelo

(57) ABSTRACT

A hemp-based structural composite having a core that includes compressed, aggregated hemp hurd and a binder; and a hemp-based outer covering affixed to and surrounding the core. The core and the outer covering may each have a predetermined volume and a predetermined shape. The hemp-based structural composite may be used wherever structural members are used, for example, to replace conventional sawn lumber. Also disclosed is a method of making a hemp-based structural composite including (a) providing non-aggregated hemp hurd; (b) forming the non-aggregated hemp hurd into a predetermined shape and a predetermined volume to form a core; (c) providing a hemp outer covering; (d) positioning the hemp outer covering over the core; and (e) affixing the hemp outer covering to the core forming the hemp-based structural composite.

19 Claims, 8 Drawing Sheets

(56) References Cited

U.S. PATENT DOCUMENTS

| | | | |
|---|---|---|---|
| 9,139,707 | B2 | 9/2015 | Hochstetter et al. |
| 9,744,753 | B2 | 8/2017 | Sheffield et al. |
| 10,100,232 | B2 | 10/2018 | Wang et al. |
| 10,118,311 | B2 | 11/2018 | Theirs et al. |
| 10,240,285 | B2 | 3/2019 | Wilson |
| 10,913,220 | B2 | 2/2021 | Laberge Lebel et al. |
| 2006/0228535 | A1 | 10/2006 | Nie et al. |
| 2006/0258783 | A1 | 11/2006 | Rettenbacher |
| 2007/0237940 | A1 | 10/2007 | Branca |
| 2008/0203604 | A1 | 8/2008 | Lalancette |
| 2012/0046394 | A1 | 2/2012 | Lu et al. |
| 2017/0121473 | A1 | 5/2017 | Lu et al. |
| 2018/0066396 | A1 | 3/2018 | Ratcliffe et al. |
| 2018/0119338 | A1 | 5/2018 | Wilson |
| 2018/0031191 | A1 | 11/2018 | Mukherji |
| 2018/0311915 | A1 | 11/2018 | Mukherji |
| 2019/0283269 | A1 | 9/2019 | Wilson |
| 2021/0045943 | A1* | 2/2021 | Blasius ..... A61F 13/474 |

FOREIGN PATENT DOCUMENTS

| | | | |
|---|---|---|---|
| CN | 100363161 | C | 1/2008 |
| CN | 101307185 | A | 11/2008 |
| CN | 101823280 | A | 9/2010 |
| CN | 101941227 | A | 1/2011 |
| CN | 102179855 | A | 9/2011 |
| CN | 102225569 | A | 10/2011 |
| CN | 202378127 | U | 8/2012 |
| CN | 103372901 | B | 10/2013 |
| DE | 29713856 | U1 | 10/1997 |
| DE | 10251518 | B4 | 10/2009 |
| JP | 2008030443 | A | 2/2013 |
| JP | 2014205268 | A | 10/2014 |
| KR | 20130066139 | A | 6/2013 |
| WO | 2007053852 | A2 | 5/2007 |
| WO | 2012074229 | A2 | 6/2012 |
| WO | 2012074230 | A2 | 6/2012 |
| WO | 2019068003 | A1 | 4/2019 |
| WO | 2019158630 | A1 | 8/2019 |

* cited by examiner

HEMP-BASED STRUCTURAL COMPOSITES AND METHODS OF MAKING HEMP-BASED STRUCTURAL COMPOSITES

CROSS-REFERENCE TO RELATED APPLICATION

This application claims priority from pending U.S. Provisional Patent Application 63/164,623, filed on Mar. 23, 2021, the disclosure of which is included by reference herein in its entirety.

BACKGROUND

Technical Field

The present invention relates generally to the field of hemp-based products, and more particularly, to hemp-based structural products, for example, as a viable alternative to natural wood-based lumber and natural wood-based products, and methods for manufacturing hemp-based structural products.

Description of Related Art

The production of traditional lumber products, especially, solid-wood lumber products, such as, the production of beams, joists, rafters, and/or "studs" (for example, "2×4s," "2×6s," "2×8s," and "4×4s," among others, as known in the art) is time intensive and laborious, often requiring large plots of land for growing and harvesting the raw timber. Moreover, when growing timber for harvesting depending on the geographic region, typically large amounts of water are required for irrigation while typically several decades are needed for timber to grow to sufficient height and diameter prior to harvesting and processing. Thus, sustainability for timber and/or natural wood products is resource dependent and time consuming.

Also, while processing the harvested timber, quality control can be problematic. Natural timber often has many imperfections, such as, knots, rotted portions, and/or other deformities and imperfections, which can lead to waste during timber processing. Moreover, due to the flammable nature of natural wood products, as well as its susceptibility to rot, these natural wood products often require pressure treatment and treatment with additives, such as, flame retardant additives, to reduce susceptibility to rot and reduce flammability. These additional processes are also expensive, laborious, and time consuming. Moreover, some natural wood products are further discarded, either during or post-pressure treatment and/or treatment with additives, due to failure of meeting quality control standards due to problems arising either during and/or after these treatments.

Accordingly, there is a need in the art for enhanced non-wood-based structural products that can overcome these recognized limitations and disadvantages of conventional timber-based structural products.

SUMMARY OF THE INVENTION

Embodiments of the present invention provide hemp-based structural products, hemp-based structural composites, or hemp-based structural members that provide improved substitutes to conventional natural wood-based products. Aspects of the present invention, the hemp-based structural composites provide substitutes and alternatives to conventional natural wood-based products that avoid the above-mentioned problems observed with natural wood products and/or lumber. In particular, the hemp-based structural composites disclosed herein are substantially more sustainable, eco-friendly, and "green" due to the time period for hemp growth and hemp harvesting (approximately 3 to 5 months versus decades for wood) and advantageously require less water per acre/square foot for irrigation/growth purposes when compared to natural timber. Moreover, when processing and making the disclosed hemp-based structural composites, production time may be reduced due to ease of handling the hemp materials used within the hemp-based structural composites. In addition, various quality control issues often experienced during processing and production of natural wood products/lumber can be minimized and/or are avoided, thus leading to far less waste of hemp material when compared to their natural wood counterparts. For example, knots do not occur within hemp and/or the disclosed hemp-based structural composites.

Moreover, hemp is naturally flame resistant, and is not readily susceptible to rot, especially when combined with additional additives (for example, binders and/or adhesives) that may further decrease susceptibility to rot. Thus, many processing and additive steps utilized in the production of natural wood products/lumber are unnecessary for the hemp-based structural composites disclosed herein. Moreover, these hemp-based structural composites, when used for construction purposes, are considerably easier to handle and manipulate when compared with their natural wood counterparts.

One embodiment of the invention comprises or includes a hemp-based structural composite comprising or including: a core comprising compressed, aggregated hemp hurd and a binder; and a hemp-based outer covering affixed to the core. In one aspect, the binder may at least partially coat a surface of individual particles of the hemp hurd wherein a plurality of the individual hemp hurds are bound by the binder within the compressed, aggregated hemp hurd. In one aspect, the binder comprises a resin or an adhesive. For example, the resin or adhesive may be one or more of a urea formaldehyde, a phenol resorcinol, a polyvinyl acetate, a diethylene glycol monobutyl ether, a polymethylenepolyphenyl isocyanate, an N-methylolacrylamide, a polyurethane, a methylene diphenyl di-isocyanate (MDI), a vinylester, a polyester, an emulsion polymer isocyanate, an Isogrip™, a phenol-formaldehyde, and a polymeric diphenylmethane diisocyanate. In one aspect, a formaldehyde-free, soy-based adhesive may be used as a binder, for example, the Soyad™ adhesive marketed by Solenis™ used in environmentally friendly plywood, or Kymene® Adhesive used in the PureBond® Process marketed by Columbia Forest Products, or its equivalent.

In one aspect, the hemp-based outer covering may be a plurality of hemp-based sheets or sheaths, for example, a plurality of hemp bast fiber sheets or sheaths.

Another embodiment of the invention is a method of making a hemp-based structural composite. The method comprises or includes: providing non-aggregated hemp hurd; combining the non-aggregated hemp hurd with a binder to produce a mixture of non-aggregated hemp hurd and binder; forming the mixture of non-aggregated hemp hurd and binder into a core having a predetermined shape; providing a hemp-based outer covering to the core; and affixing the hemp-based outer covering to the core to provide the hemp-based structural composite. In one aspect, the method may further comprise introducing a binder to the hemp-based outer covering. For example, in one aspect, introducing the binder to the hemp-based outer covering may be practiced prior to, during, and/or after positioning the hemp-based outer covering onto the core. In another aspect, introducing the binder to the hemp-based outer covering may be practiced prior to, during, and/or after affixing the hemp-based outer covering to the core.

In one aspect, forming the mixture into the core having a predetermined shape may be practiced by introducing the mixture to a containment tube.

In another aspect, providing the hemp-based outer covering to the core may comprise providing a plurality of hemp-based sheets to the core and/or providing a plurality of hemp-based rovings to the core.

A further embodiment of the invention is a hemp-based structural composite comprising or including: a core comprising compressed, aggregated hemp hurd and a first binder formed into a predetermined shape; a hemp-based outer covering affixed to the core, the hemp-based outer covering comprising a plurality of hemp bast fibers and a second binder; and a hemp-based outermost covering affixed to the hemp-based outer covering. In one aspect, the first binder and the second binder may be the same or a different binder.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF ASPECTS OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use, and practice the invention. Like reference numbers refer to like elements throughout the various drawings.

Hemp-Based Structural Composites

Figure 2:
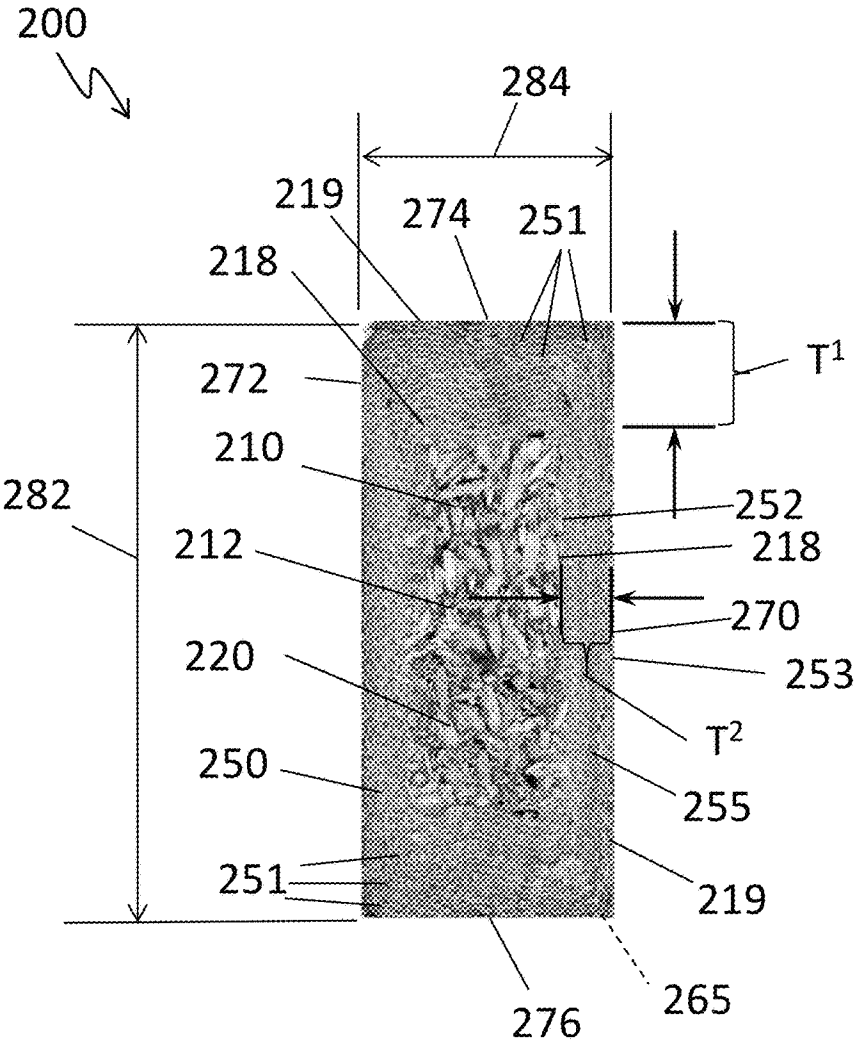
FIG. 2 is a black and white photograph of a cross-section of an exemplary hemp-based structural composite according to one aspect of the invention.
Figure 1:
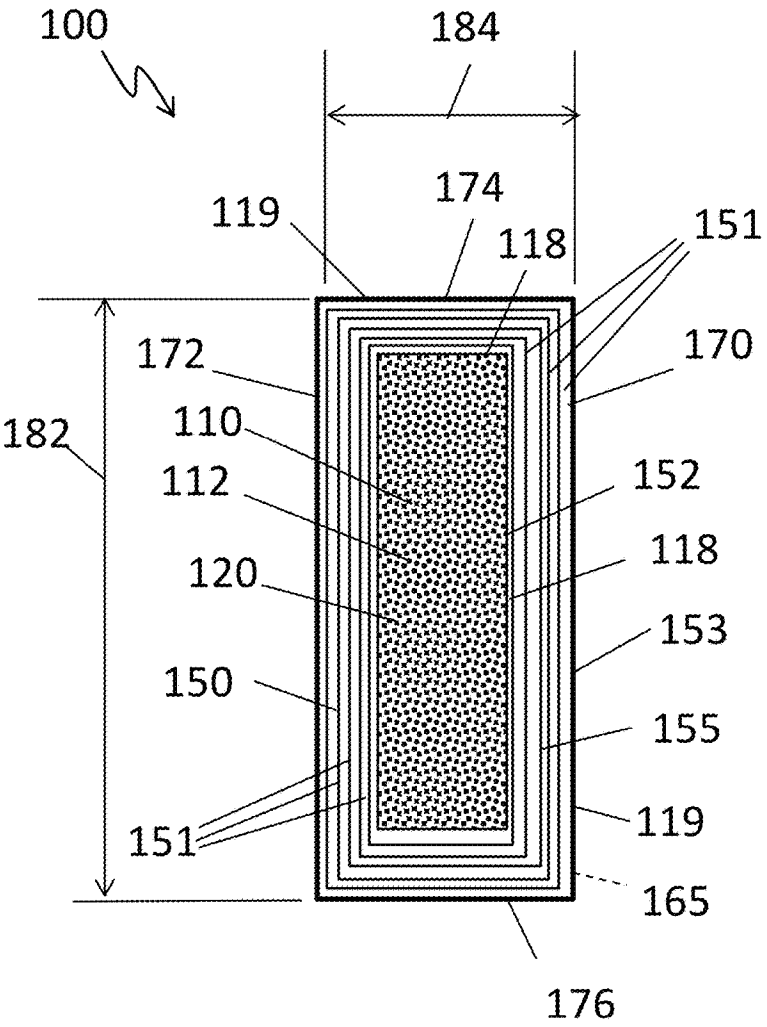
FIG. 1 depicts a schematic illustration of a cross-section of a hemp-based structural composite according to one aspect of the invention.
Figure 3:
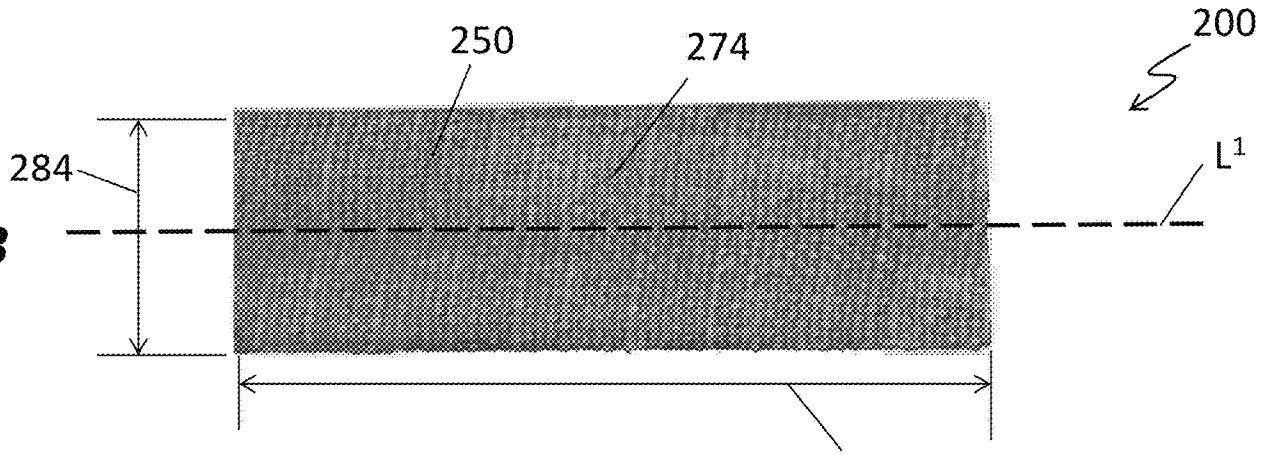
FIG. 3 is a black and white photograph of a top plan view of the exemplary hemp-based structural composite shown in FIG. 2, the bottom view being a mirror image thereof.
Figure 4:
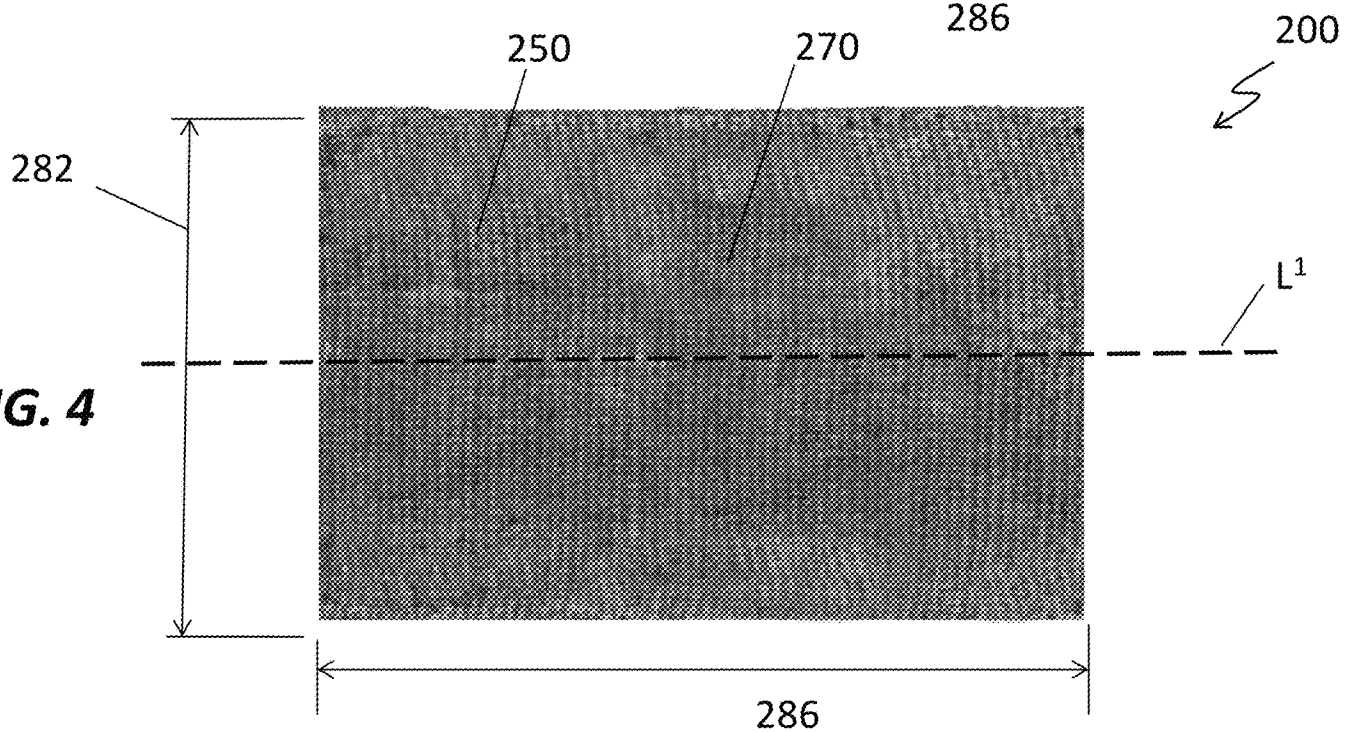
FIG. 4 is a black and white photograph of a left-side elevation view of the exemplary hemp-based structural composite shown in FIG. 2, the right-side elevation view being a mirror image thereof.

FIGS. 1 through 6 generally depict the hemp-based lumber composites 100 and 200 disclosed herein. FIG. 1 depicts a schematic illustration of a cross-section of a hemp-based structural composite 100 according to one aspect of the invention. FIG. 2 is a black and white photograph of a cross-section of an exemplary hemp-based structural composite 200 according to one aspect of the invention. FIG. 3 is a black and white photograph of a top plan view of the exemplary hemp-based structural composite 200 shown in FIG. 2, the bottom view being a mirror image thereof. FIG. 4 is a black and white photograph of a left-side elevation view of the exemplary hemp-based structural composite 200 shown in FIG. 3, the right-side elevation view being a mirror image thereof.

These composites 100, 200 are a viable substitute to conventional natural-wood-based products, for example, sawn-wood-based products, and other prior art structural elements. However, in contrast to natural-wood-based lumber products, composites 100, 200 according to aspects of the invention are substantially more sustainable, eco-friendly, and "green" than conventional natural-wood-based lumber products. In addition, composites 100, 200 may be more easily handled and manipulated while in use when compared to their natural-wood-based lumber counterparts. Moreover, when compared to conventional natural-wood-based lumber products, composites 100, 200 may have far less quality control issues. Further still, composites 100, 200 are less susceptible to rot, and may be far more flame resistant than natural-wood-based lumber products, thus potentially reducing overall production time and expenses when compared to natural-wood-based lumber products.

In the following discussion and throughout this Specification and in the attached Claims, the expression "hemp-based" means that at least one component of the invention is derived from "hemp" or from what is referred to in the art as "industrial hemp." However, in other aspects, hemp-based may mean that the structural composites disclosed herein are entirely made from hemp-based components. For example, as used herein, "hemp" may refer to a *Cannabis sativa* cultivar grown specifically for industrial use. However, it is envisioned that aspects of the present invention may be applied to any bast fiber species, for example, bamboo, bagasse, flax, jute, kenaf, ramie, roselle, hardwood, or softwood, that may provide the cellulose-based components that are equivalent to or characterized by the hemp-based components disclosed herein.

As known in the art, hemp typically grows as stalks, and when harvested the hemp stalks may be treated mechanically, chemically, or chemi-mechanically to isolate hemp bast fiber, hemp hurd, and hemp microfibers (also known as "green microfibers"). As known in the art, this process may be referred to as "decortication." Hemp bast fibers consists of long and string-like fibers which are typically produced in the outer portions of the hemp stalks. Hemp hurd resembles wood chips in their structure and are found in the interior of the hemp stalks. (Hemp hurd is similar to what may generally be referred to as hardwood or softwood "shives.") Hemp microfibers typically comprise the fine fibrous material that may be produced during the processing of the hemp stalk. Though hemp microfibers may be present in both hemp bast fiber and in hemp hurd, it is not believed that the presence or absence of hemp microfibers in the hemp bast fiber and the hemp hurd referenced herein affects the quality or value of the structural composites of aspects of the present invention.

According to one aspect of the invention, FIGS. 1-4 show hemp-based structural composites 100, 200 including: core 110, 210 comprising compressed, comminuted hemp hurd 112, 212; and a hemp outer covering 150, 250 affixed to and surrounding the core 110, 210. In one aspect, the comminuted hemp hurd core 110, 210 may have a predetermined shape and/or a predetermined volume, and the hemp outer covering 150, 250 may be woven and may have a predetermined shape and/or a predetermined volume, for example, a shape similar to the shape of the core 110, 210. In one aspect, the core 110, 210 may be of substantially uniform construction, for example, devoid of any voids or openings, for instance, a "solid" core. In other aspects, the core 110, 210 may include one or more voids or openings, while still providing the desired structural and other characteristics disclosed herein. For example, in one aspect, the core 110, 210 may comprise a honeycomb-type structure.

According to aspects of the invention, the core 110, 210 includes a binder 120, 220 that binds or at least partially adheres together the comminuted hemp hurd 112, 212. In one aspect, the binder 120, 220 may coat at least a portion of the surfaces of some of the individual hemp hurds 112, 212. For example, the binder 120, 220 may partially coat or substantially completely coat the outer surfaces of the individual hemp hurds 112, 212, such that a plurality of individual hemp hurds 112, 212 are bound to one another by the binder 120, 220 within the comminuted hemp hurd core 110, 210. For example, in one aspect, the binder 120, 220 in core 110, 210 may be a resin or an adhesive, for instance, a resin or an adhesive comprising a urea formaldehyde (for example, a Weldwood® Plastic Resin Glue having urea formaldehyde), a phenol resorcinol, a polyvinyl acetate (for example, a Titebond®, Titebond®I, Titebond®II, Titebond®III having polyvinyl acetate), a diethylene glycol monobutyl ether (for example, a Titebond® Ultimate Wood Glue), a polymethylenepolyphenyl isocyanate (such as, in a polyurethane glue) and/or an N-methylolacrylamide (for example, a Titebond® Premium Wood Glue), a polyurethane (for example, Loctite® HB X032 Purbond® adhesive or Loctite® GT20 Purbond® adhesive), a methylene diphenyl di-isocyanate (MDI), a vinylester, a polyester, or an emulsion polymer isocyanate (for example, an Isoset™), an Isogrip™, a phenol-formaldehyde, a polymeric diphenylmethane diisocyanate (for example, a Rubinate 1840™), a combination thereof, or their equivalents. In one aspect, a formaldehyde-free adhesive may be used as a binder, for example, the Soyad™ adhesive marketed by Soleni™ used in environmentally friendly plywood, or Kymene® Adhesive used in the PureBond® Process marketed by Columbia Forest Products, or its equivalent. It is envisioned that, in one aspect, the binder may be omitted without detracting from aspects of the invention. For example, when core 110, 210 can be fabricated under sufficient compression where the hurd particles sufficiently adhere to provide sufficient structural integrity when little or no binder is present.

As further shown in FIGS. 1 through 4, the hemp outer covering 150, 250 may comprise a plurality of hemp-based sheets or sheaths 151, 251. Hemp-based sheets or sheaths 151, 251 may be woven or non-woven. For example, hemp sheaths 151, 251 of outer covering 150, 250 may be woven or non-woven bast hemp fiber sheets. In one aspect, the sheaths 151, 251 may comprise substantially continuous or discontinuous layers of hemp-based material wrapped around the core 110, 210. In one aspect, the sheaths 151, 251 may be provided in a tubular construction, for example, with sheaths 151, 251 comprising substantially continuous, uninterrupted enclosures applied to the cores 110, 210. In another aspect, the sheaths 151, 251 may comprise discontinuous or discreet layers or sheets that are wrapped around the core 110, 210, for instance, at least partially overlapping one another. (See FIGS. 10 through 14 for an example of this method of construction.) According to this aspect, a plurality of hemp sheaths 151, 251 may provide a concentric shape about the core 110, 210, for example, a semi-deformed concentric shape as shown in FIG. 2 or a somewhat uniform concentric shape as shown in FIG. 1. For example, in one aspect, as specifically shown in FIGS. 1 and 2, the concentric shape of sheaths 151, 251 may be formed internally within the composite 100, 200 and the concentric shapes can be seen when the hemp-based structural composite 100, 200 is viewed in cross-section. The concentric shape hemp-based structural composite 100, 200 is preferably a polygonal shape when viewed in cross-section, for example, a regular polygon shape, including, but not limited to, a rectangular shape (FIGS. 1 through 4), a square shape, a triangular shape, a pentagon shape, a hexagon shape, a heptagon shape, or an octagon shape, for example, when viewed in cross-section. Hemp-based structural composite 100, 200 may also be substantially round, circular, or elliptical in cross section.

According to one aspect of the invention the hemp-based outer covering 150, 250 may include a binder 155, 255 provided to at least partially bind at least some of the plurality of hemp-based sheets or sheaths 151, 251. In one aspect, the binder 155, 255 may substantially completive bind at least a majority, if not substantially all, the hemp-based sheets or sheaths 151, 251 to provide a substantially integrated construction of the hemp-based outer covering 150, 250. In one aspect, the binder 155, 255 in hemp-based outer covering 150, 250 may be any one or more of the resins or adhesives disclosed herein, for instance, a resin or an adhesive comprising a urea formaldehyde. It is envisioned that, in one aspect, the binder 155, 255 may be omitted from hemp-based outer covering 150, 250 without detracting from aspects of the invention. For example, when hemp-based outer covering 150, 250 can be fabricated under sufficient compression where the sheets or sheaths 151, 251 sufficiently adhere to provide sufficient structural integrity when no little or no binder is present.

As further shown in FIGS. 1 and 2, hemp-based structural composite 100, 200 may have an right-hand outer surface, 170, 270; a left-hand outer surface 172, 272; an upper outer surface 174, 274; and a lower outer surface 176, 276. In one aspect, the right-hand outer surface 170, 270; the left-hand outer surface 172, 272; the upper outer surface 174, 274; and the lower outer surface 176, 276 of the hemp-based structural composite 100, 200 may have substantially planar faces, for example, when the hemp-based structural composite 100, 200 is viewed in cross-section and/or from a perspective view.

Figure 16:
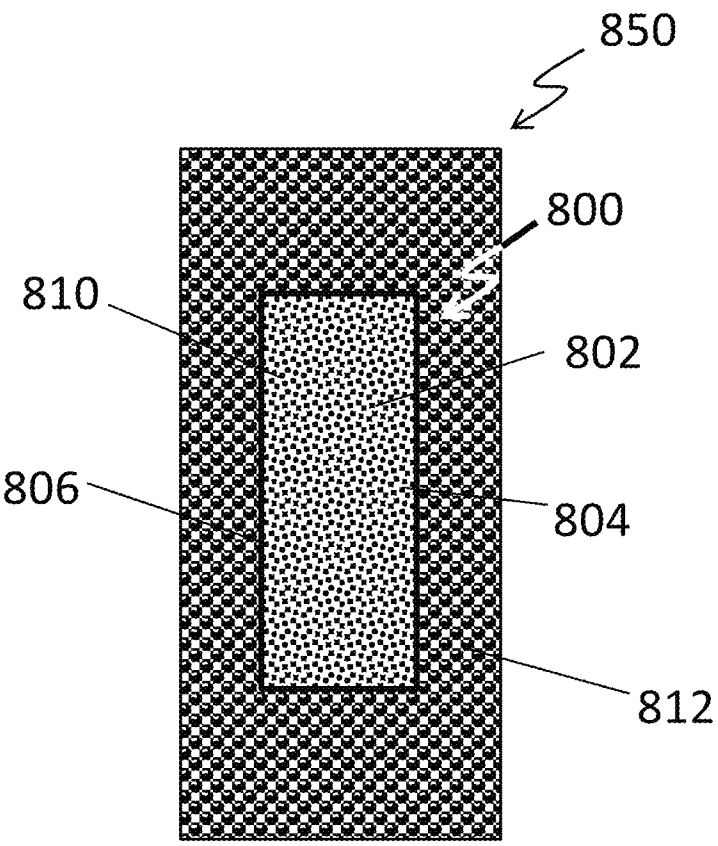
FIG. 16 is a schematic cross section of a hemp-based structural composite comprising a cured core comprising the cured assembly shown in FIG. 15 according to one aspect of the invention.
Figure 15:
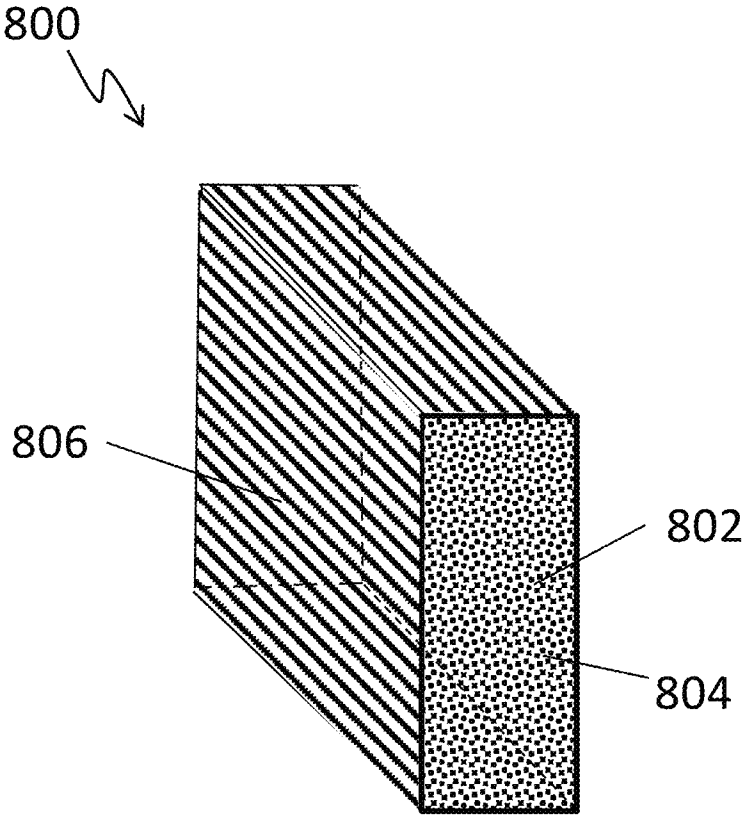
FIG. 15 is a schematic perspective view of an assembly of hemp hurd and a binder within an enclosure or container according to one aspect of the invention.

As shown in the cross-sectional views of FIGS. 1 and 2, each sheath or sheet 151, 251 of the plurality of hemp sheaths or sheets may be typically bonded to or otherwise affixed to adjacent sheaths or sheets 151, 251 of plurality of hemp sheaths or sheets. In one aspect, with an innermost sheath 152, 252 of plurality of hemp sheaths 151, 251 may comprise a substantially continuous sheath (for example, a tubular or "sock"-like construction, as shown in FIGS. 15 and 16) that is typically bonded to or otherwise affixed to the core 110, 210, and an outermost sheath 153, 253 of plurality of hemp sheaths 151, 251 forming an outer surface of the hemp-based structural composite 100, 200. The plurality of hemp sheaths 151, 251 is compressed together and form the right-hand surface 170, 270; the left-hand surface 172, 272; the upper surface 174, 274; and the lower surface 176, 276 of the hemp-based structural composite 100, 200. In certain aspects, the innermost sheath 152, 252 may vary in the type of construction, for example, may be woven, unwoven, braided, and/or knitted, and innermost sheath 152, 252 may comprise a different fabric weight when compared to the other sheaths 151, 251. For example, the innermost sheath 152, 252 may have a fabric weight of about 6 ounces per yard, while the non-innermost sheaths 151, 251 may have a fabric weight of about 17 ounces per yard.

In certain aspects, the innermost sheath 152, 252 may be substantially continuous (for example, of tubular construction) while the other sheaths 151, 251 surrounding the innermost sheath 152, 252 may be of non-tubular construction (for example, configured for wrapping around the longitudinal axis ($L^1$) of the core 110, 210) and/or of tubular construction. In certain aspects, the outermost sheath 153, 253 may be configured for customization, which includes having one or more indicia, for example, etched, printed, and/or woven indicia thereon, and/or having an aesthetically pleasing appearance, for example, having a wood grain appearance or a carbon fiber appearance, among others.

As further shown in the cross-sectional view of FIG. 2, the plurality of sheaths 151, 251 adjacent the upper surface 174, 274 and the plurality of sheaths 151, 251 adjacent the lower surface 176, 276 of the hemp-based structural composite 100, 200 may have a thickness or "flange thickness" $T^1$, measured from an outermost surface 118, 218 of the core 110, 210 to the outer surface 119, 219 of the hemp-based structural composite 100, 200; and the plurality of sheaths 151, 251 adjacent the right-hand surface 170, 270 and the plurality of sheaths 151, 251 adjacent the left-hand surface 172, 272 may have a thickness or "web thickness" $T^2$, measured from the outermost surface 118, 218 of the core 110, 210 to the outer surface 119, 219 of the hemp-based structural composite 100, 200. In one aspect, the flange thickness $T^1$ may be 1 to 6 times the web thickness $T^2$, for example, depending upon the method of construction of the composite 100, 200. However, $T^1$ may typically be 1 to 3 times the web thickness $T^2$. For instance, $T^1$ may be about equal to $T^2$, may be about twice $T^2$, or may be about 3 times $T^2$. According to aspects, of the invention, depending upon the size of composites 100, 200, flange thickness $T^1$ may be 0.125 inches to 6 inches, but is typically, from about 0.5 inches to 0.75 inches; web thickness $T^2$ may be 0.125 inches to 4 inches, but is typically, from about 0.25 inches to 0.375 inches.

As shown in FIGS. 1 through 4, hemp-based structural composites 100, 200, and any hemp-based composite disclosed herein, may have a height 182, 282; a thickness or width 184, 284; and a length 286. According to aspects of the invention, height 182, 282 may range from about ¼ inch [in.] to about 8 feet [ft.], but is typically, from about 2 in. to about 18 in., for example, 3.5 in. in height. Width 184, 284 may range from about ¼ in. to about 8 ft., but is typically, from about W in. to about 5.25 in., for example, 1.5 in. in width. Length 286 may range from about 6 in. to about 48 ft., but is typically, from about 92⅝ in. to about 24 ft., for example, 8 ft. in length.

Figure 5:
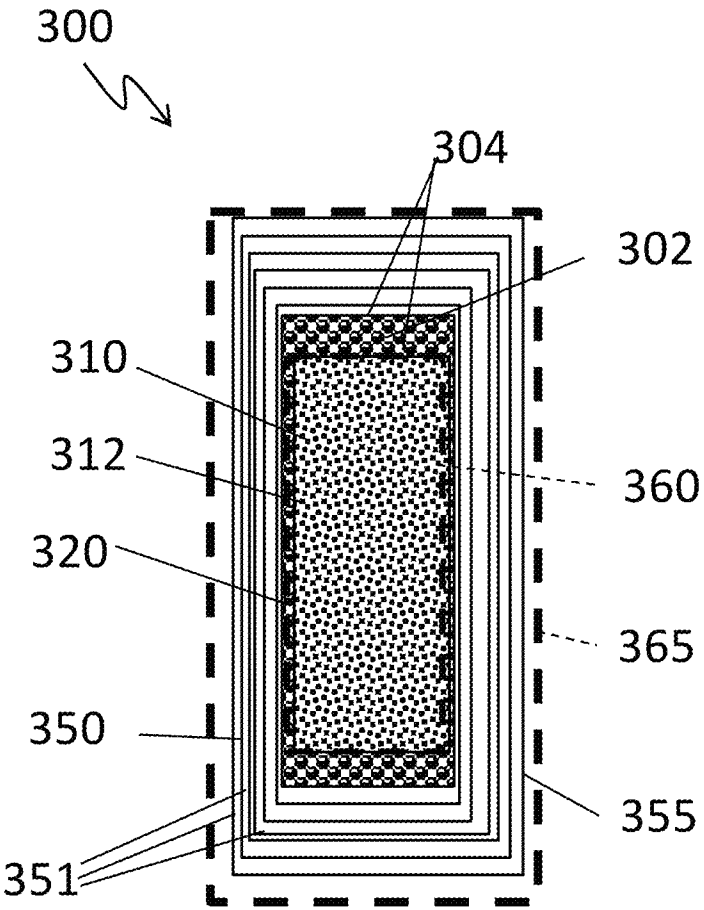
FIG. 5 depicts a schematic illustration of a cross-section of another hemp-based structural composite, having rovings, according to one aspect of the invention.

FIG. 5 depicts a schematic illustration of a cross-section of another hemp-based structural composite 300, having rovings 302, according to one aspect of the invention. In a fashion similar to the hemp-based structural composite 100 and 200 disclosed herein, hemp-based structural composite 300 shown in FIG. 5 includes a core 310 comprising compressed, comminuted hemp hurd 312; a binder 320 that binds the comminuted hemp hurd 312; and hemp-based outer covering 350 affixed to and surrounding the core 310. The hemp-based outer covering 350 may typically comprise hemp-based sheets or sheaths 351 and a binder 355, as disclosed herein. The core 310, the comminuted hemp hurd 312, the hemp outer covering 350, the hemp-based sheets or sheaths 351, and the binder 320, 355 of hemp-based structural composite 300 may have all the features, characteristics, and dimensions of the core 110, 210; the comminuted hemp hurd 112, 212; the hemp outer covering 150, 250; the hemp-based sheets or sheaths 151, 251, and the binder 120, 220, 155, 255 of hemp-based structural composites 100, 200 disclosed herein.

In the aspect of the invention shown in FIG. 5, hemp-based structural composite 300 includes at least some rovings 302, for example, unidirectional rovings, or strands of fiber 304. As known in the art, rovings may typically comprise a collection of parallel strands (assembled roving), for example, parallel strands of bast fibers, or parallel continuous filaments (direct roving), for example, parallel continuous filaments of hemp-based bast fibers, assembled without intentional twist. In other aspects, the strands of fiber 304, for example, strands of bast fiber, may comprise elongated, narrow bundles of fiber, threads of fiber, or strands of fiber. As known in the art, a strand may comprise an assembly of simultaneously produced parallel continuous filaments, for example, parallel continuous filaments of hemp-based bast fiber, slightly bonded and without intentional twist. The rovings 302 and bundles, threads, or strands 304 are shown schematically in FIG. 5 (and in FIG. 6) and not to scale to facilitate disclosure of this aspect of the invention. In this aspect, the rovings 302 may comprise elongated, narrow bundles, threads, or strands 304 of hemp fiber, for example, elongated, narrow bundles, threads, or strands of bast hemp fibers.

Though in one aspect of the inventions rovings 302 or strands 304 may comprise a substantially continuous elongated rovings 302 or fiber strand 304, for example, repeatedly wrapped about core 310, in other aspects, rovings 302 or fiber strand 304 may comprise a plurality of rovings or fiber strands of substantially predetermined length that are positioned and somehow bonded to the core 310, and to adjacent rovings 302 or fiber strands 304.

According to one aspect, the strands 304 or rovings 302 may be "unidirectional," that is, mounted or somehow attached to core 310 and to the adjacent fiber strands 304 or rovings 302 where substantially all the individual rovings 302 or strands 304 extend in a single direction, for example, in the longitudinal or axial direction of hemp-based structural composite 300 substantially parallel to the longitudinal axis $L^1$ shown in FIGS. 3 and 4. It is also envisioned that the rovings 302 or strands 304 may not be unidirectional, for example, the rovings 302 or strands 304 may be multi-directional, for instance, bi-directional (that is, in two predetermined directions), tri-directional (that is, in three predetermined directions), or more, depending, for example, on the intended direction of loading on the hemp-based structural composite 300. In one aspect, the rovings 302 or strands 304 may not all be substantially omni-directional, that is, oriented in a multiplicity of directions to provide a desired load distribution.

In one aspect, the orientation of the rovings 302, for example, substantially parallel to the longitudinal axis $L^1$ of composite 300 may improve the structural strength and/or integrity of composite 300, for example, by the increasing bend resistance of composite 300, especially along the longitudinal axis $L^1$ of the composite 300. The roving 302 may provide a substantially uniform thickness of the outer covering 350 surrounding the core 310. Moreover, the amount and thickness of the individual rovings 302 or strands 304 may be varied depending on the desired strength, shape, volume, and dimensions of the resulting hemp-based structural composite 300.

Figure 6:
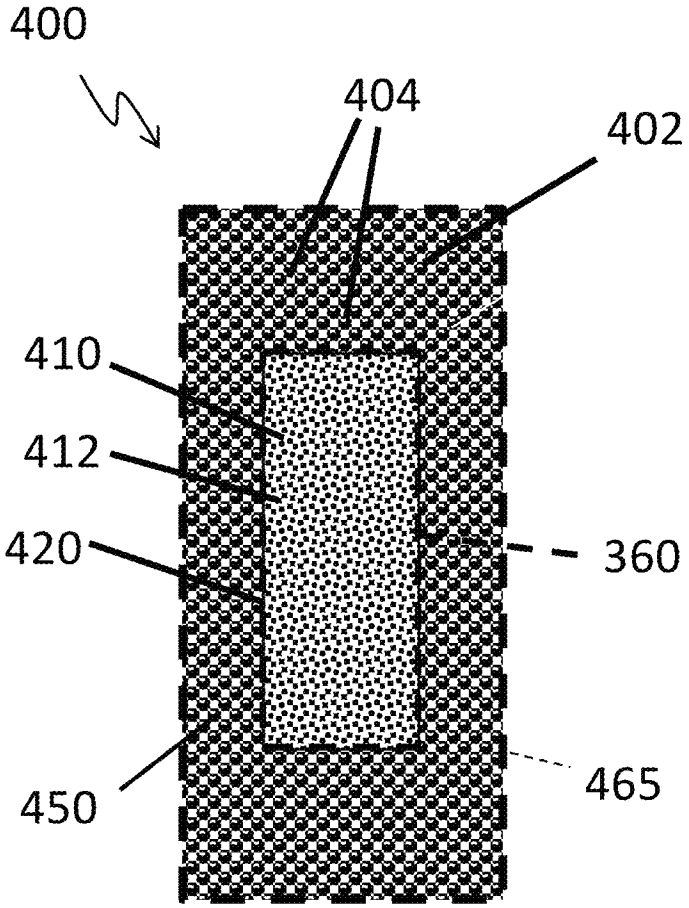
FIG. 6 depicts a schematic illustration of a cross-section of another hemp-based structural composite, having rovings, according to one aspect of the invention.

In one aspect, hemp-based structural composite 300 may comprise a core 310 and rovings 302 or strands 304 about the core 310 (as shown in FIG. 5). In certain additional aspects, the core 310 may include a woven hemp sheath, for example, a tubular construction or a "hurd core containment tube", 360 as shown in FIGS. 5 and 6, affixed to the core 310 with the rovings 302 or strands 304 affixed/positioned over the hemp-based tubular construction 360. In one aspect, additional hemp-based tubular construction 360, for example, in the form of a tubular construction (see FIGS. 15 and 16, enclosure 806) and/or sheaths 351 having ends (see FIGS. 10 through 14, sheets or sheaths 712 and 714) may be positioned over the rovings 302 or strands 304 of composite 300.

FIG. 6 depicts a schematic illustration of a cross-section of another hemp-based structural composite 400, having rovings 402, according to one aspect of the invention.

In a fashion similar to the hemp-based structural composite 100, 200, and 300 disclosed herein, hemp-based structural composite 400 shown in FIG. 6 includes a core 410 comprising compressed, comminuted hemp hurd 412; and a binder 420 that binds the comminuted hemp hurd 412. The core 410, the comminuted hemp hurd 412, and the binder 420 of hemp-based structural composite 400 may have all the features, characteristics, and dimensions of the core 110, 210, 310; the comminuted hemp hurd 112, 212, 312; and the binder 120, 220, 320 of hemp-based structural composites 100, 200, and 300 disclosed herein. However, in the aspect of the invention shown in FIG. 6, the hemp outer covering 150, 250, 350 of hemp-based structural composites 100, 200, and 300 is replaced entirely by outer covering 450 having rovings 402 or strands 404, for example, unidirectional rovings or strands, having individual fiber bundles, strands, or threads, 404, as disclosed herein. Rovings 402 and strands 404, may have all the features, characteristics, direction, and dimensions of rovings 302 and strands 304 of hemp-based structural composites 300 disclosed herein.

As shown in FIG. 6, hemp-based structural composite 400 may substantially only include the core 410 comprising compressed, comminuted hemp hurd 412; a binder 420 that binds the comminuted hemp hurd 412, and rovings 402.

In one aspect, hemp-based structural composite 100, shown in FIG. 1, hemp-based structural composite 200, shown in FIGS. 2 through 4, hemp-based structural composite 300, shown in FIG. 5, and hemp-based structural composite 400, shown in FIG. 6, may include an outermost covering or "veil" 165, 265, 365, and 465, respectively. This outermost covering 165, 265, 365, and 465 may be provided to, among other things, give an aesthetic appearance; retain sheets, sheaths, rovings, or strands; or facilitate handling during or after fabrication, for example, to facilitate engagement with fabrication machines or tooling. The outermost covering or veil may be mounted to the respective structural composite by any one or more of the binders disclosed herein.

Figure 8:
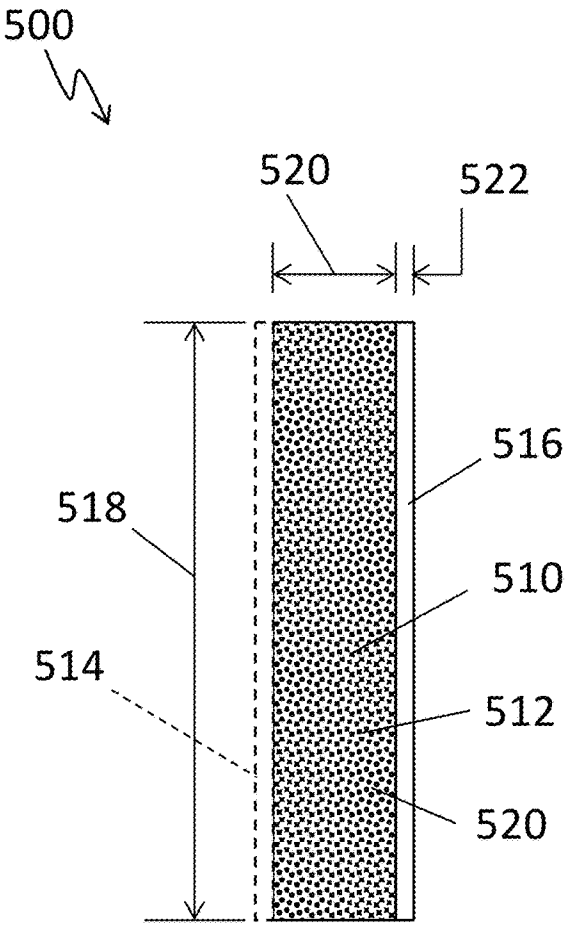
FIG. 8 is a schematic side elevation view of the hemp-based structural composite shown in FIG. 7.
Figure 7:
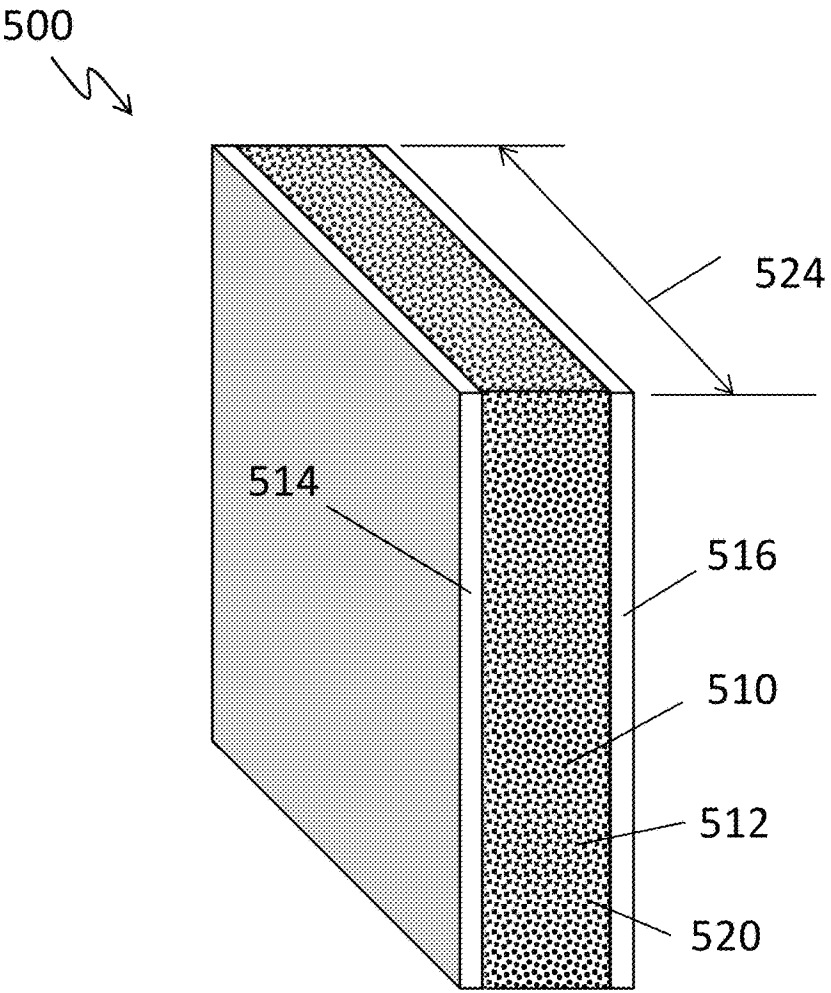
FIG. 7 is a schematic perspective view of a hemp-based structural composite according to another aspect of the invention.

FIG. 7 is a schematic perspective view of a hemp-based structural composite 500 according to another aspect of the invention. FIG. 8 is a schematic side elevation view of the hemp-based structural composite 500 shown in FIG. 7. In a fashion similar to the hemp-based structural composite 100, 200, 300, and 400 disclosed herein, as shown in FIGS. 7 and 8, hemp-based structural composite 500 comprises a panel-type structure having a core 510 comprising compressed, comminuted hemp hurd 512; and a binder 520 that binds the comminuted hemp hurd 512. However, in the aspect shown in FIGS. 7 and 8, the core 510 is "sandwiched" between hemp-based sidewalls 514 and 516, for example, fabricated from hemp bast fibers. In one aspect, sidewalls 514 and 516 may be referred to as "stress skins," that is, structures provided to enhance the structural integrity of the hemp-based structural composite 500, for example, when under a bending load. In one aspect, hemp-based structural composite 500 may comprise a laminar construction having alternating lamella of one or more hemp-based sidewalls 514 and 516 and one or more hemp-based cores 510.

As shown most clearly in FIG. 8, according to one aspect, only a single sidewall 516 may be provided, where optional side wall 514 is shown in phantom. Hemp-based sidewalls 514 and 516 may be mounted to or otherwise affixed to core 510, for example, using one or more of the adhesives or binders disclosed herein. The core 510, the comminuted hemp hurd 512, and the binder 520 of hemp-based structural composite 500 may have all the features, characteristics, and dimensions of the core 110, 210, 310, 410 and the comminuted hemp hurd 112, 212, 312, 412, respectively, disclosed herein.

In one aspect, sidewalls 514, 516 may not be hemp-based, but may be fabricated from another cellulose-product, such as, wood; a plastic, or a metal. In this aspect, hemp-based core 510 may provide a substrate, for example, a substrate having the desired structural rigidity, thermal insulation, flame resistance, rot resistance, and/or pest resistance, to which one or more hemp-based or non-hemp-based sidewalls 514, 516 may be mounted, for example, with one or more of the adhesives disclosed herein. The exposed surface of the hemp-based or the non-hemp-based sidewalls 514, 516 may be provided with an aesthetically pleasing appearance, for example, having a wood grain appearance or a carbon fiber appearance, among others.

Hemp-based sidewalls 514 and 516 may typically comprise hemp bast fibers, for example, a sheet or sheath fabricated from hemp-based fibers, as disclosed herein. In one aspect, sidewalls 514 and 516 may comprise hemp-based rovings, for example, rovings having unidirectional, non-unidirectional, or multi directional individual threads or strand, as disclosed herein. The sidewalls 514 and 516 may have all the features, characteristics, and dimensions of the hemp outer covering 150, 250, 350, 450 disclosed herein.

Though the hemp-based structural composite 500 shown in FIGS. 7 and 8 is illustrated as having a generally rectangular cross section, it is envisioned that hemp-based structural composite 500, having the generally laminar construction shown in FIGS. 7 and 8, may have a broad range of cross sections, including but not limited to polygonal, including triangular, square, rectangular, or rhomboid; oval, elliptical, or circular. It is envisioned that aspects of the present invention shown in FIGS. 7 and 8 may take any desirable architectural, structural, or engineering shape or cross section, for example, I-beam or T-beam shape, and C-channels, among others, and as reflected in the shapes of typical molding, for example, ogee molding, crown molding, and quarter-round molding, and the like.

It is also envisioned that the hemp-based structural composite 500 shown in FIGS. 7 and 8, for example, having a single sidewall 514 may be used for architectural siding, for example, for a home or building. For example, in one aspect, the singe-sidewall embodiment shown in FIG. 8 may be used for building siding, with the side wall 516 exposed, and the unsidewalled surface of core 510 concealed. It is believed that the sidewall 516 and core 510 may provide at least some thermal insulation, at least some resistance to rot, and at least some resistance to penetration by insects and other undesirable pests. In one aspect, the external surface of exposed sidewall 516 may be treated or otherwise molded or shaped to provide an esthetically pleasing appearance, for example, a wood grain or a natural stone fascia.

As shown in FIGS. 7 and 8, hemp-based structural composite 500 may have a height 518; a core thickness or width 520; a sidewall thickness or width 522; and a length 524. According to aspects of the invention, height 518 may range from about 1 in. to about 8 ft., but is typically, from about 2 in. to about 24 in., for example, 12 in. in height. Core width 520 may range from about ¼ in. to about 6 ft., but is typically, from about W to about 12 in., for example, 2 in. in width. Sidewall width 522 may range from about 1/16 in. (0.0626 in.) to about 2 ft., but is typically, from about ¼ in. to about 2 in., for example, W in. in width. Length 524 may range from about 6 in. to about 50 ft., but is typically, from about 4 ft. to about 16 ft., for example, 8 ft. in length.

Methods of Making

The hemp-based structural composites 100, 200, 300, 400, and 500 disclosed herein may be fabricated by a broad range of fabrication processes depending, amongst other things, on the size and the number of composites produced. For example, in one aspect, cores 110, 210, 310, 410, and 510, may be fabricated by combining hemp hurd with a binder, for example, manually mixed, and then compressing the mixture of hemp hurd and binder into a cavity, for example a rectangular cavity, and then allowing the mixture to cure. The hemp-based sheaths or sheets 151, 251, 351, hemp-based rovings 302, 402; and/or hemp-based sidewalls 514, 516 disclosed herein may then be positioned, for example, manually positioned, on to the at least partially cured core 110, 210, 310, 410, or sidewalls 514, 516, for example, with one or more of the adhesives disclosed herein.

Figure 9:
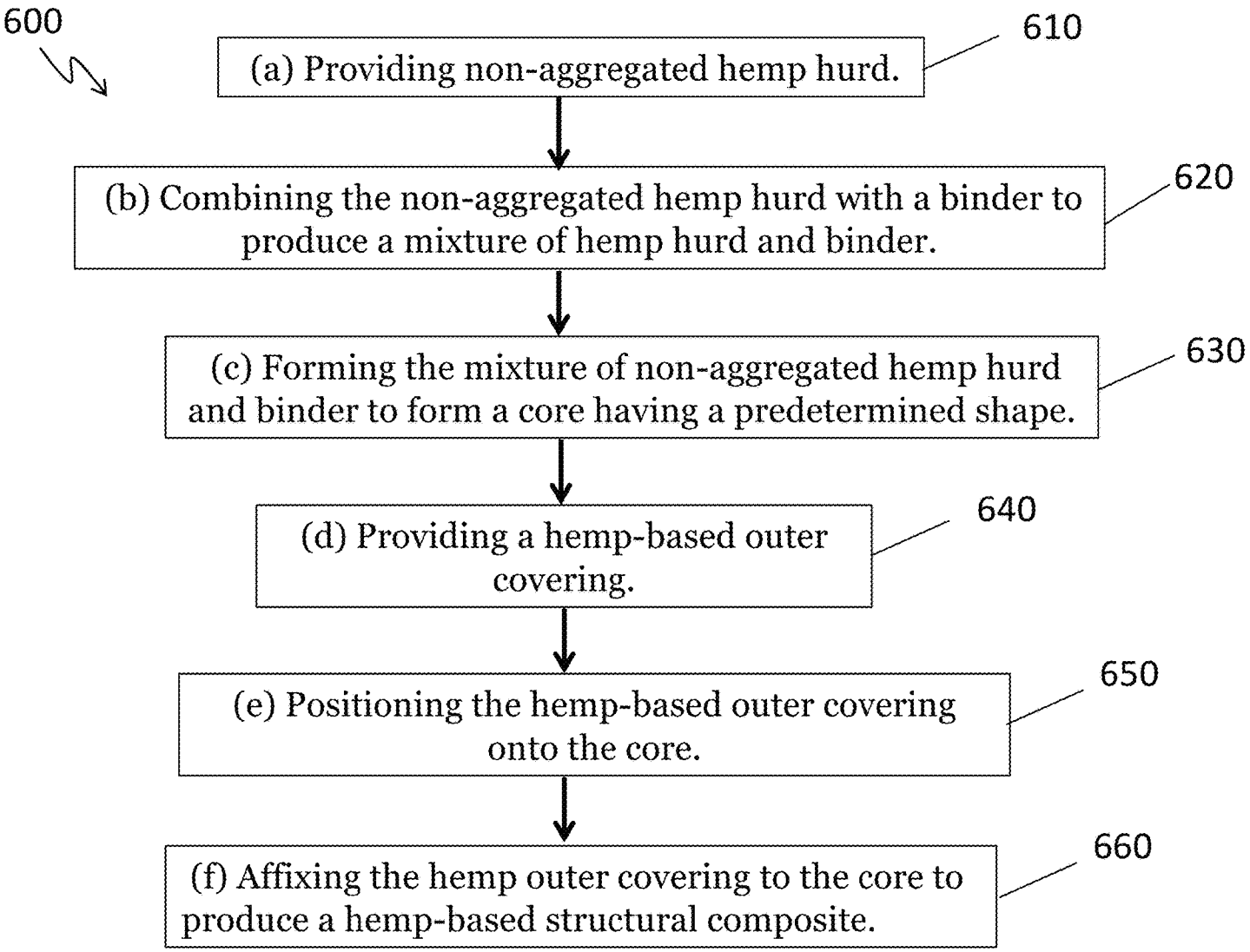
FIG. 9 presents a flow chart of methods for fabricating hemp-based structural composites according to an aspect of the invention.

A flowchart 600 of a general method for fabricating or making the hemp-based structural composites 100, 200, 300, 400, and 500 disclosed herein is shown in FIG. 9. As shown in FIG. 9, flow chart 600: includes (a) providing non-aggregated hemp hurd, 610; (b) combining the non-aggregated hemp hurd with a binder to produce a mixture of hemp hurd and binder, 620; (c) forming (for example, compressing) the mixture of non-aggregated hemp hurd and binder to form a core having a predetermined shape, 630; (d) providing a hemp-based outer covering, 640; (e) positioning the hemp-based outer covering onto the core, 650; and (f) affixing the hemp-based outer covering to the core to produce a hemp-based structural composite, 660, such as, hemp-based structural composites 100, 200, 300, 400, and 500 disclosed herein.

In the above and in the following discussion, the expression "non-aggregated hemp hurd" refers to loose particulate hemp hurd prior to processing according to aspects of the invention. Non-aggregated hemp hurd of step (a), 610 may comprise non-aggregated hemp hurd as provided by the source of the hemp hurd, for example, a loose, particulate hurd provided from a hemp farmer or the package hemp hurd provided by a hemp processor, such as, Hemp Inc., having headquarters in Las Vegas, Nevada; or Hemp Traders of Paramount, California, among others.

Regarding step (b), 620, combining the hemp hurd with a binder, for example, with any one or more of the binders disclosed herein, may typically comprise mixing the non-aggregated hemp hurd with a binder, for example, manually mixing in a container or with an automated mixer, such as, a "continuous mixer."

Regarding step (c) 630, forming the mixture to form a core, may be practiced in various methods, for example, compressing the mixture into a mold having a predetermined shape or extruding the mixture through a die or hollow mandrel having a predetermined shape and allowing the mixture to at least partially cure (typically, substantially cure), among other methods for forming a core having a predetermined shape. In one aspect, as disclosed herein, step (c) 630, forming the mixture to form a core, may include introducing the mixture of non-aggregated hemp hurd and binder to hurd core containment tube, for example, 806 shown in FIG. 15. In one aspect, the core mixture of hemp hurd and binder may be directed through the cavity of a hollow mandrel and the sheets of the outer covering may be shaped over the outer surface of the same mandrel and then the shaped core and shaped outer covering may be combined after passing the mandrel, and, for example, prior to being introduced to curing.

Regarding step (d) 640, providing a hemp-based outer covering, may be practiced by providing any one of the sheets or sheaths of hemp-based material disclosed herein, for example, woven or non-woven sheets of hemp bast fiber or multiple rovings of hemp-based fiber.

Regarding step (e) 650, positioning the hemp-based outer covering onto the core, may be practiced by positioning the hemp-based sheets or rovings of step (d), 640, upon the core provided in step (c), 630, manually or by automated means. For example, the hemp-based outer cover and the core may be introduced prior to or while extruded in an automated extruder or an automated "pultruder," and co-extruded or co-pultruded.

Regarding step (f), 660, affixing the hemp outer covering to the core, may be practiced by affixing the hemp-based outer covering on the core with a binder or an adhesive, for example, using any one or more of the binders/adhesives disclosed herein. Though the introduction of the binder or the adhesive may be practiced in step (f), 660, in one aspect, the introduction of the binder or adhesive to the hemp-based outer covering may be practiced prior to step (f), for example, during or after step (d), 640; or prior to, during, and/or after step (e), 650. In one aspect, the introduction of the binder or the adhesive to the hemp-based outer covering may be practiced in a bath application, a ribbon application, a curtain application, a roller transfer coating, a brush application, and/or a spray application, among other application methods. The step of affixing (f), 660, may be practiced manually or by automated means. For example, the affixing of the hemp-based outer cover to the core may be practiced substantially simultaneously with step (e), 650, for example, using an automated extruder or the automated pultruder of step (e), 650.

In one aspect of the invention, the method 600 shown in FIG. 9 may further include the step (g), not shown in FIG. 9, of introducing a cover to the hemp-based structural composite generated in step (f), for example, an outer-most cover to the hemp-based structural composite. The outer cover may be a non-hemp-based cover or a hemp-based cover, for example, similar to the outermost covering or "veil" 165, 265, 365, and 465 disclosed herein. In one aspect, an outer-most cover may be provided by one or more hemp-based sheets, hemp-based sheaths, hemp-based rovings, or hemp-based strands disclosed herein. In one aspect, the outer cover may be provided by a braiding, for example, by continuous braiding of a cover about the hemp-based structural composite generated in step (f). In one aspect, a hemp-based outer cover may be provided by automated radial braiding, for example, by transferring the hemp-based structural composite generated in step (f) through an automated radial braiding device.

Figure 10:
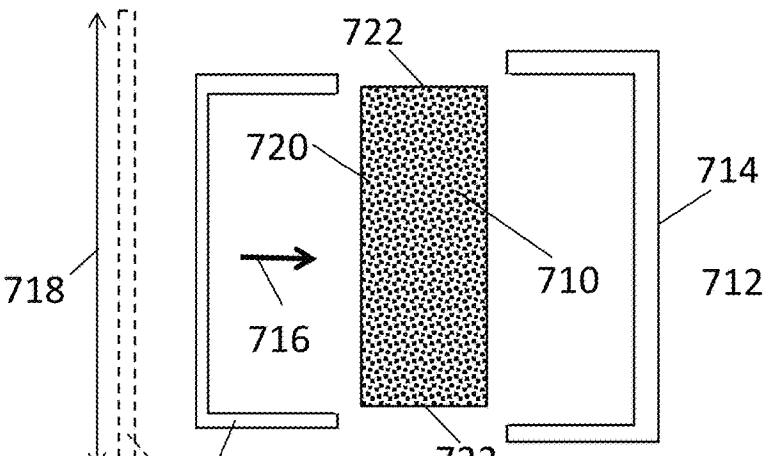

One method of practicing steps (e) and (f) shown in FIG. 9 is shown in FIGS. 10 through 14. FIGS. 10 through 14 show a schematic illustration of one process that may be used to implement method steps (e) and (f) shown in FIG. 9. FIG. 10 is a schematic side elevation view of a core 710, for example, the core 110, 210, 310, or 410 disclosed herein, and a plurality of hemp-based sheets or sheaths 712, 714. Hemp-based sheets 712, 714 may comprise any one or more the hemp-based sheets or sheaths disclosed herein, for example, woven or unwoven hemp bast fiber sheets or sheaths or woven or unwoven bast roving sheets or sheaths, or hemp-based rovings or strands.

According to aspects of the invention, as shown in FIG. 10, first, hemp-based sheet 712 may be positioned upon core 710, as indicated by arrow 716. As shown in FIG. 10, in one aspect, hemp-based sheets 712 and 714 may be provided in a predetermined shape, for example, C-shape, to properly engage the shape of core 710 as desired. Though a C-shape, or what may be referred to as an "interlocking C channel sheath," may be shown in FIG. 10, it is envisioned that sheets 712 and 714 may assume a broad range of cross-sectional sizes and shapes depending, among other things, upon the size and shape of core 710.

As shown in phantom in FIG. 10, sheet 712 may have a width 718 prior to engaging core 710 that, when engaging core 710, sheet 712 covers a side 720 of core 710 and at least partially covers the opposing ends 722 of core 710. In one aspect, the length 718 may be long enough that, when sheet 712 is applied to core 710, the side 720 and at least the entire widths of ends 722 of core 710 are covered by sheet 712. The application of sheet 712 to core 710 may typically be enhanced with the use of one or more of the binders/adhesives disclosed herein. The resulting application of sheet 712 to core 710 produces an assembly of sheet 712 and core 710 is shown in FIG. 11.

Figure 11:
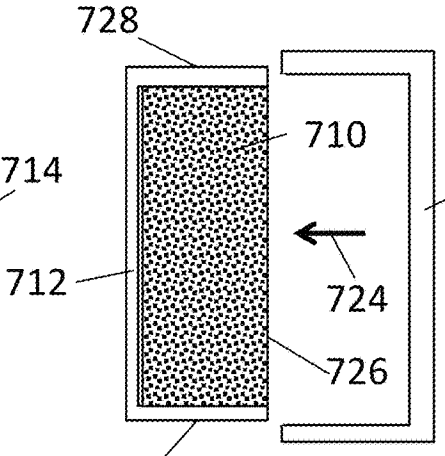

According to aspects of the invention, as shown in FIG. 11, after mounting or affixing sheet 712 upon core 710, in a similar fashion, sheet 714 is positioned on the assembly of core 710 and sheet 712, as indicated by arrow 724. As shown in FIG. 11, hemp-based sheets 714 may be provided in a predetermined shape, for example, a C-channel shape, to properly engage the shape of core 710 and sheet 712 as desired. As shown in FIG. 11, sheet 714 may have a width where, after engaging the assembly of core 710 and sheet 712, sheet 714 covers a side 726 of core 710 and at least partially covers the opposing ends 728 of the assembly of core 710 and sheet 712. In one aspect, the length of sheet 714 may be long enough that, when sheet 714 is applied to the assembly of core 710 and sheet 712, at least the entire widths of ends 728 of the assembly of core 710 and sheet 712 are covered by sheet 714. The application and adherence of sheet 714 to the assembly of core 710 and sheet 712 may typically be enhanced with the use of one or more of the adhesives disclosed herein. The resulting application of sheet 714 to the assembly of core 710 and sheet 712 produces an assembly of core 710, sheet 712, and sheet 714 is shown in FIG. 12.

Figure 12:
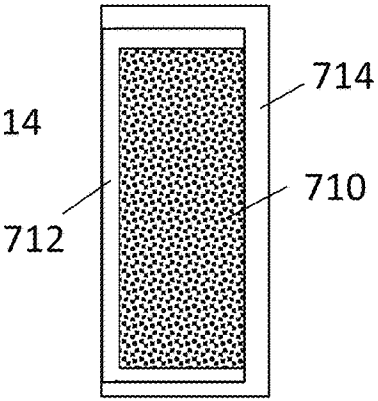
FIGS. 10 through 14 show a schematic illustration of one process that may be used to implement methods shown in FIG. 9.
Figure 14:
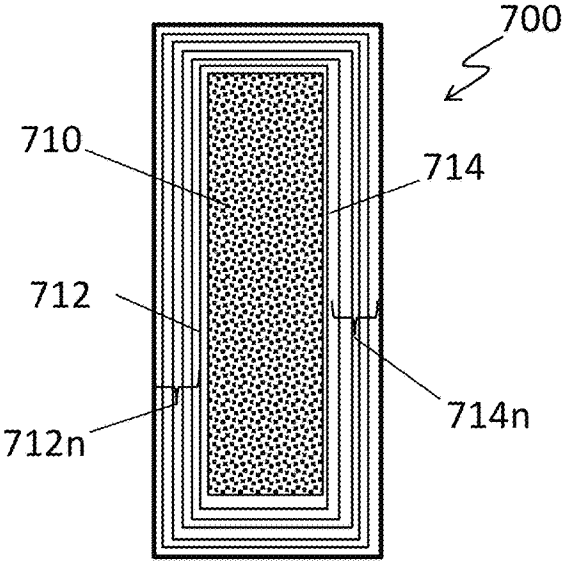
Figure 13:
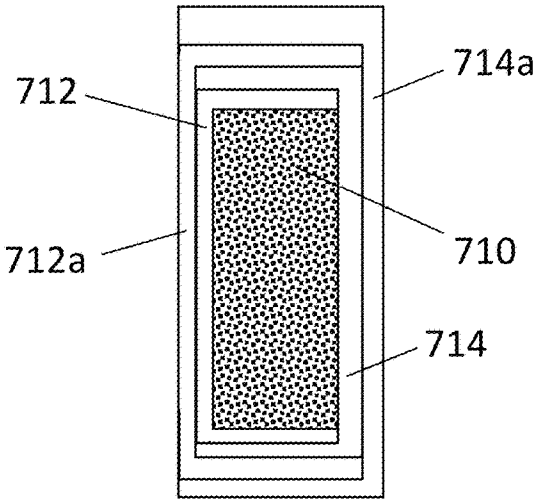

FIG. 13 is a schematic side elevation view of an assembly of core 710, a plurality of hemp-based sheets or sheaths 712, 714, and the addition of similar sheets 712*a* and 714*a*, after repeating the process shown in FIGS. 10 through 12 with similar sheets 712*a* and 714*a*, for example, a C-channel shaped sheets 714*a* and 714*b* (not shown). FIG. 14 is a schematic side elevation view of an assembly of core 710, a plurality of hemp-based sheets or sheaths 712, 714, with the addition of similar numerous sheets 712*n* and 714*n*, similar in shape and construction of sheet 712 and 714, after repeating the process shown in FIG. 10 through 12 with similar sheets 712*n* and 714*n*, for example, a C-channel shaped sheets 714*n* and 714*n* to produce the hemp-based structural member 700 according to an aspect of the invention. Hemp-based structural member 700 may be similar in shape and construction to any one or more of hemp-based structural members 100, 200, 300, and 400 disclosed herein.

The number of sheets of "n" pairs of overlapping sheets 712*n* and 714*n* shown in FIG. 14 may range from n of at least 2 to n of more than 100 or more than 1000. However, typically, the number of overlapping pairs of sheets n according to aspects of the invention may range from 2 pairs of sheets to 15 pairs of sheets, for example, about 10 pairs of sheets.

Though aspects of the invention include hemp-based structural composites having a broad range of shapes and dimensions for hemp-based cores 110, 210, 310, 410, and 510 and a broad range of shapes and dimensions for hemp-based coverings 150, 250, 350, and 450, the method of construction of hemp-based structural composite 700 shown in FIGS. 10 to 14 indicates one reason for the shapes and sizes of the hemp-based structural composite 100 shown in FIG. 1, structural composite 200 shown in FIGS. 2 through 4, structural composite 300 shown in FIG. 5, and structural composite 400 shown in FIG. 6. In the aspect of the invention shown in FIGS. 10 through 14, the repeated overlapping of the ends of the core and sheet assemblies, for example, overlapping of ends 728 shown in FIG. 11, by subsequent sheets, for example, sheets 712*n* and 714*n*, may yield a covering thickness of the opposing ends of the hemp-based structural member (see thickness $T^i$ in FIG. 2) at about twice as thick as the covering thickness along the opposing sides of the structural member (see thickness $T^2$ in FIG. 2). This may simply be due to the overlapping of twice the sheets or sheaths 712*n* and 714*n* on the ends of structural composite 700 compared to the sides of structural composite 700. It is envisioned that the relationship of these thicknesses may vary due to, among other things, manufacturing tolerances; the flexibility of the materials from which the coverings are made, for example, the flexibility of the materials from which the sheets 712*n* and 714*n* are made; the use of one or more hurd core containment tubes; or the introducing of rovings on or about structural composite 700, among other things.

FIGS. 15 and 16 show a schematic illustration of another process that may be used to implement the methods shown in FIG. 9, for example, as a process that may be used to implement step (b), combining the non-aggregated hemp hurd with a binder to produce a mixture of hemp hurd and binder, 620, and step (c), forming the mixture of non-aggregated hemp hurd and binder into a core having a predetermined shape, 630, shown in FIG. 9.

FIG. 15 is a schematic perspective view of an assembly 800 of hemp hurd 802 and a binder 804 within an enclosure or container 806. In one aspect, enclosure 806 may be referred as a hurd core containment tube. According to aspects of the invention, enclosure 806 may be used to facilitate handling of hemp hurd 802 or of hemp hurd 802 and binder 804, for example, when handling the hemp hurd 802 or of hemp hurd 802 and binder 804 when practicing the processes shown and described with respect to FIG. 9 or FIGS. 10 through 14. Binder 804 may be any one or more of the binders disclosed herein.

In one aspect, enclosure 806 may be made of a flexible material, for example, a fabric, for example, a fine woven fabric or a coarse woven fabric, for instance, enclosure 806 may comprise a netting. For example, in one aspect, enclosure 806 may be referred to as a "sock." In one aspect, enclosure 806 may be a knitted material, a braided material, a woven material, or an unwoven material. In one aspect, enclosure 806 may be made of a hemp-based material, for example, woven or non-woven hemp bast fibers. In one aspect, the weave of enclosure 806 may be small enough to retain the hemp hurd 802, for example, having openings of at most ¼ inch or smaller.

Though in the schematic illustration shown in FIG. 15, enclosure 806 is shown generally rectangular in cross section, according to aspects of the invention, the shape of the cross-section of enclosure 806 may vary broadly, for example, due to, among other things, the flexibility of the material from which enclosure 806 is made, the size of enclosure 806, and the weight of the hemp hurd 802 and binder 804. For example, the cross-section of enclosure 806 may be polygonal, circular, elliptical, or amorphous due to the flexibly of the material of enclosure 806.

FIG. 16 is a schematic cross-section view of a hemp-based structural composite 850 comprising a cured core 810 comprising the cured assembly 800 having hemp hurd 802 and binder 804 within enclosure 806 shown in FIG. 15 and surrounded with hemp-based covering 812. Hemp-based covering 812 may comprise any one of the hemp-based coverings disclosed herein, for example, hemp bast sheets or sheaths or hemp-based rovings or strands, such as, hemp-based sheet or sheath coverings 150, 250, and 350, or rovings 302 or 402. Hemp-based covering 812 may be encased or covered by an outermost covering or "veil" (not shown in FIG. 16), such as outermost covering 165, 265, 365, and 465, disclosed herein.

According to the aspect shown in FIGS. 15 and 16, the fabrication of any one of the hemp-based structural composites disclosed herein may be facilitated by using an enclosure 806, for example, a hemp-based enclosure, to facilitate handling of the hemp hurd or hemp hurd and binder. According to one aspect of the invention, the enclosure 806 is maintained after fabrication as a part of the hemp-based structural composite produced.

Figure 17:
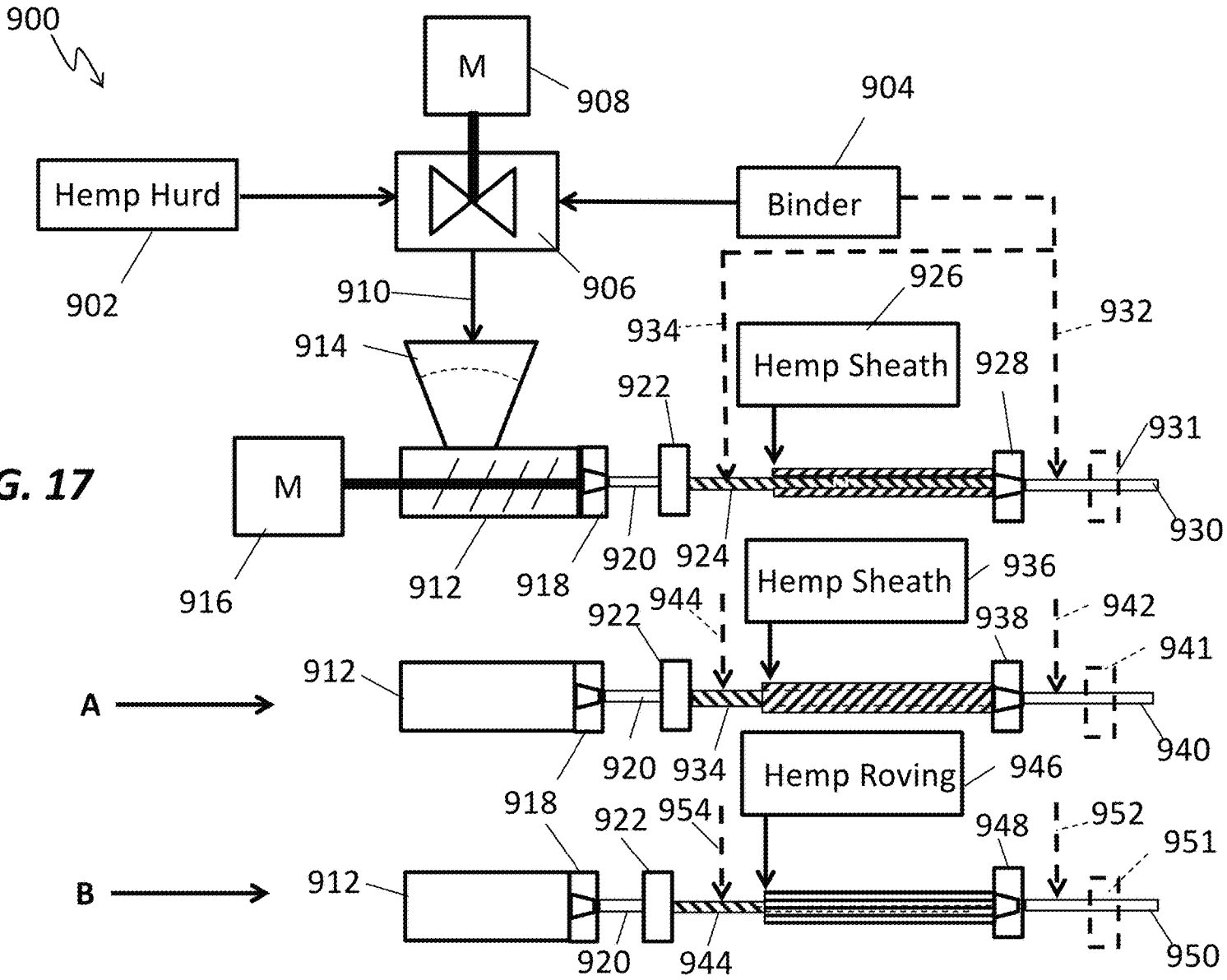
FIG. 17 is a schematic illustration of processes or methods that may be used to fabricate hemp-based structural composites disclosed herein according to aspects of the present invention.

FIG. 17 is a schematic illustration 900 of processes or methods that may be used to fabricate hemp-based structural composites, such as, hemp-based structural composites 100, 200, 300, 400, 500, 700, and 850, disclosed herein, according to aspects of the present invention. As shown in FIG. 17, according to this aspect, hemp hurd 902, for example, non-aggregated hemp hurd, and binder 904 may be introduced to a mixing device 906. Hemp hurd 902 may be provided by a hemp hurd provider, for example, Hemp Traders, and introduced to mixing device 906 manually or by automated means, for example, by a screw conveyor, a belt conveyor, and/or a chute, and binder 904 may be any one or more of the binders disclosed herein. Mixing device 906 may be driven by an electric motor 908 and be adapted to sufficiently mix hemp hurd 902 and binder 904 to provide a substantially uniform mixture 910 hemp hurd 902 and binder 904. Though mixing device 906 may be in any commercially available mixing device, in one aspect, mixing device 906 may be a continuous processor, for example, a continuous mixer provided by ReadCo Kurimoto, LLC of York, Pennsylvania, or its equivalent.

After combining hemp hurd 902 and binder 904 in mixer 906, the mixture 910 is forwarded to and compressed in a compressing device 912, for example, having a feed hopper 914. Compressing device 912 may be driven by motor 916 and compress mixture 910 against a die or into a mandrel 918 to compress mixture 910 to a previously defined cross section to create a hemp-based structural composite core 920 of compressed hemp hurd 902 and binder 904, as disclosed herein. Though compressing device 912 may be in any commercially available compressing device, in one aspect, compressing device 912 may be a screw-driven compressing device, for example, a "Double Arm Mixer Extruder" having bi-directional rotating arms and a screw-driven compressing chamber, for instance, a Double Arm Mixer Extruder provided by JayGo Incorporated of Randolph, New Jersey, or its equivalent.

Depending upon the type of binder used, the binder 904 may begin to at least partially cure prior to or while being introduced to hurd 902 in mixer 906. However, typically, after being discharged from die 918, the binder 904 in core 920 may be at least partially cured. Therefore, according to aspects of the invention, after core 920 is discharged from die 918, the core 920 is treated in a curing process 922 to at least partially additionally cure the binder 904 to produce an at least partially cured core 924. The curing process 922 may comprise heat, ultraviolet light, moisture, and/or radio frequencies.

According to one aspect of the invention, the at least partially cured core 924 is then combined with hemp-based sheets or sheaths 926, as disclosed herein, for example, on one or on two opposite sides of core 924. The core 924 and sheaths 926 are then further compressed over a mandrel or through a die 928 of predetermined size to produce a hemp-based structural composite 930, for example, the hemp-based structural composite 500 shown in FIGS. 7 and 8. Though the compression of the one or more sheaths or sheets 926 and the core 924 through a die or over a mandrel 928 may be practiced using any conventional compressing device, such as, a press, for example, a continuous press. In one aspect, the compressing may be practiced using a continuous press similar to the press used to manufacture laminated veneer lumber (LVL) or oriented strand board (OSB), that is, "plywood." In one aspect, the compression of the one or more sheaths or sheets 926 and the core 924 may be practiced via pultrusion, as known in the art. For example, the partially cured core 924 and the hemp-based sheets or sheaths 926 may be pultruded through a die 928 with a pultrusion rate ranging from 0.5 meters/minute [m/min] to 3.0 meters/minute, and at a pressure of 40 pounds per square inch [psi] to 60 psi. Other pultrusion processes or continuous presses disclosed herein may also be practiced under these conditions.

As shown in FIG. 17, further binder 904 may be introduced to core 924 or to structural composite 930 as indicated by binder addition 932 and 934 (shown in phantom), for example, to enhanced the cohesion of the sheaths 926 with the core 924. In addition, in one aspect, after exiting die 928 structural composite 930 may be further cured 931 if necessary. The curing process 931 may comprise heat, ultraviolet light, moisture, and/or radio frequencies.

According to another aspect of the invention, as indicated by arrow A in FIG. 17, after being treated in mixer 906 and compression device 912, discharged from die 918, and then cured 922, the at least partially cured core 934 may then be combined with hemp-based sheets or sheaths 936, as disclosed herein, for example, on two or more sides of core 934 (and typically on all four sides of core 934) and then further compressed in a die 938 of predetermined size to produce a hemp-based structural composite 940, for example, the hemp-based structural composite 100 shown in FIG. 1, composite 200 shown in FIG. 2 through 4, or composite 700 shown in FIG. 14. Though the compression of the one or more sheaths or sheets 936 and the core 934 may be practiced using any conventional compressing device, such as, a continuous press, in one aspect, the compression of the one or more sheaths or sheets 936 and the core 934 may be practiced via pultrusion, as known in the art.

As shown in FIG. 17, further binder 904 may be introduced to core 934 or to structural composite 940 as indicated by binder additions 942 and 944 (shown in phantom), for example, to enhanced the cohesion of the sheaths 936 with the core 934. In addition, in one aspect, after exiting die 938 structural composite 940 may be further cured 941 if necessary. The curing process 941 may comprise heat, ultraviolet light, moisture, and/or radio frequencies.

According to another aspect of the invention, as indicated by arrow B in FIG. 17, after being treated in mixer 906 and compression device 912, discharged from die 918, and then cured 922, the at least partially cured core 944 may then be combined with a plurality of hemp-based rovings 946, as disclosed herein, for example, on one or more sides of core 944 (and typically on all four sides of core 944) and then further compressed in a die 948 of predetermined size to produce a hemp-based structural composite 950, for example, the hemp-based structural composite 300 shown in FIG. 5, or the composite 400 shown in FIG. 6. Though the compression of the plurality of rovings 946 and the core 944 may be practiced using any conventional compressing device, such as, a continuous press in one aspect, the compression of the plurality of rovings 946 and the core 944 may be practiced via pultrusion, as known in the art.

As shown in FIG. 17, further binder 904 may be introduced to core 944 or to structural composite 950 as indicated by binder 952 and 954 (shown in phantom), for example, to enhanced the cohesion of the rovings 946 with the core 944. In addition, in one aspect, after exiting die 948 structural composite 950 may be further cured 951 if necessary. The curing process 951 may comprise heat, ultraviolet light, moisture, and/or radio frequencies.

In one aspect, the container or hurd core containment tube 806 may be used in one or more of the processes shown in FIG. 17. For example, a containment tube 806 may be positioned downstream of the mandrels or dies 918, 928, 938, or 948 and be used to capture the core/binder mixture in a containment tube 806 to maintain the integrity of the core or facilitate further handling of the core. For example, in one aspect, a containment tube 806 may be used to capture core 920, 924, 934, or 944 and after introduction of the desired outer covering 926, 936, 946, the core 920, 924, 934, 944, covering, and containment tube 806 may be compressed in downstream mandrel or die 928, 938, or 948. Accordingly, in one aspect, the subsequent structural composite 930, 940, or 950 may then include an inner-most layer about the core comprising a containment tube similar to 806 containment tube and/or an outer-most layer of the outer covering comprising a containment tube similar to containment tube 806 applied to the outside structural composite 930, 940, or 950.

In one aspect of the invention, the outermost sheath or sheet of the outer cover of structural composite 930, 940, and/or 950 (or of any hemp-based structural composite disclosed herein) may include lettering, designs, lines or marks indicating cutting or trimming locations, or other aesthetically pleasing indica. These indicia may include, for example, a basket weave pattern, multi-color patterns, company/team logos, custom wording, safety messages, customer custom design, lines or marks indicating cutting or trimming locations, or graphic designs, among others. In addition, post processing of structural composite 930, 940, and/or 950 (or of any hemp-based structural composite disclosed herein) may provide aesthetic enhancements, for example, via laser etching, screen printing, and/or ink jet printing.

As disclosed herein, hemp-based structural composites or members and methods of making hemp-based structural composites or members are disclosed that distinguish from and overcome the disadvantages of prior art structural elements and prior art structural composites.

The hemp-based structural composites 100, 200, 300, 400, 500, 700, and 850 disclosed herein may preferably adhere to the standards of or are compliant with the American Lumber Standard Committee (ALSC), for example, having various predetermined nominal dimensions including, but not limited to, 1 inch by 1 inch, 2 inches by 4 inches, 2 inches by 6 inches, 2 inches by 8 inches, and 4 inches by 4 inches. Moreover, the hemp-based structural composites 100, 200, 300, 400, 500, 700, and 850 may be formed into and/or included within wall studs, floor joists, roof trusses, insulated panels, door moldings, doors and jambs, flooring, any construction composite requiring a constant cross-section, or any combination thereof.

The terminology used herein is for the purpose of describing particular embodiments only and is not intended to be limiting of the disclosure. As used herein, the singular forms "a", "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated. Any and all such equivalent embodiments and examples are within the scope of the present invention and are intended to be covered by the appended claims.

What is claimed is:

1. A hemp-based structural member comprising:

a core comprising compressed, aggregated hemp hurd and a binder; and a hemp-based outer covering affixed to the core to provide the hemp-based structural member.

2. The hemp-based structural member as recited in claim 1, wherein the binder at least partially coats a surface of individual particles of the hemp hurd wherein a plurality of the individual hemp hurds are bound by the binder within the compressed, aggregated hemp hurd.

3. The hemp-based structural member as recited in claim 2, wherein the binder comprises a resin or an adhesive.

4. The hemp-based structural member as recited in claim 3, wherein the resin or adhesive comprises one or more of a urea formaldehyde, a phenol resorcinol, a polyvinyl acetate, a diethylene glycol monobutyl ether, a polymethylenepolyphenyl isocyanate, an N-methylolacrylamide, a polyurethane, a methylene diphenyl diisocyanate (MDI), a vinylester, a polyester, an emulsion polymer isocyanate, a polyurethane-based adhesive, a soy-based adhesive, a phenol-formaldehyde, and a polymeric diphenylmethane diisocyanate.

5. The hemp-based structural member as recited in claim 1, wherein the hemp-based outer covering comprises a plurality of hemp-based sheets.

6. The hemp-based structural member as recited in claim 5, wherein the plurality of hemp-based sheets comprises hemp bast fibers.

7. The hemp-based structural member as recited in claim 5, wherein an innermost sheet of the plurality of hemp-based sheets comprises a tubular enclosure.

8. The hemp-based structural member as recited in claim 5, wherein the plurality of hemp-based sheets defines an upper outer surface, a lower outer surface, a left-hand outer surface, and a right-hand outer surface.

9. The hemp-based structural member as recited in claim 8, wherein the left-hand outer surface and the right-hand outer surface have a thickness measured to the core that is 1 to 3 times greater than a thickness measured to the core of the upper outer surface and the lower outer surface.

10. The hemp-based structural member as recited in claim 5, wherein the plurality of hemp-based sheets is adhered to one another by one of a resin and an adhesive.

11. The hemp-based structural member as recited in claim 10, wherein the one of the resin and the adhesive comprises at least one of urea formaldehyde, phenol resorcinol, polyvinyl acetate, diethylene glycol monobutyl ether, polymethylenepolyphenyl isocyanate, N-methylolacrylamide, Polyurethane, methylene diphenyl di-isocyanate (MDI), vinylester, polyester, emulsion polymer isocyanate, polyurethane-based adhesive, soy-based adhesive, phenol-formaldehyde, and polymeric diphenylmethane diisocyanate.

12. The hemp-based structural member as recited in claim 1, wherein the member is formed by pultrusion of the core and the hemp-based outer covering.

13. The hemp-based structural member as recited in claim 1, wherein the hemp-based outer covering comprises rovings.

14. The hemp-based structural member as recited in claim 1, wherein the rovings comprise unidirectional rovings.

15. The hemp-based structural member as recited in claim 13, wherein the rovings comprise elongated, narrow bundles, threads, or strands of hemp fiber.

16. The hemp-based structural member as recited in claim 1, wherein the hemp-based structural member comprises a substitute for conventional natural wood structural products.

17. The hemp-based structural member as recited in claim 1, wherein the structural member further comprises an exposed surface having an aesthetically pleasing appearance.

18. A hemp-based structural composite comprising:

a core comprising compressed, aggregated hemp hurd and a binder; and a hemp-based outer covering affixed to the core;

wherein the hemp-based outer covering comprises a plurality of hemp-based sheets; and wherein an innermost sheet of the plurality of hemp-based sheets comprises a tubular enclosure.

19. The hemp-based structural composite as recited in claim 17, wherein the hemp-based structural composite comprises a hemp-based structure.

* * * * *